US012589903B2

(12) United States Patent
Gressler et al.

(10) Patent No.: US 12,589,903 B2
(45) Date of Patent: Mar. 31, 2026

(54) PACKAGING BAG RECEIVING APPARATUS FOR A PACKAGING MACHINE, PACKAGING MACHINE AND METHOD

(71) Applicant: HDG-Verpackungsmaschinen GMBH, Lindlar (DE)

(72) Inventors: Martin Gressler, Bergisch Gladbach (DE); Dirk Wagner, Wipperfürth (DE); Georg Manz, Ruppichteroth (DE)

(73) Assignee: HDG-Verpackungsmaschinen GMBH, Lindlar (DE)

( * ) Notice: Subject to any disclaimer, the term of this patent is extended or adjusted under 35 U.S.C. 154(b) by 149 days.

(21) Appl. No.: 18/575,749

(22) PCT Filed: Jul. 1, 2022

(86) PCT No.: PCT/EP2022/068282

§ 371 (c)(1),
(2) Date: Aug. 29, 2024

(87) PCT Pub. No.: WO2023/275364

PCT Pub. Date: Jan. 5, 2023

(65) Prior Publication Data

US 2024/0417123 A1 Dec. 19, 2024

(30) Foreign Application Priority Data

Jul. 2, 2021 (DE) ..... 102021206976.2

(51) Int. Cl.
*B65B 43/00* (2006.01)
*B65B 43/46* (2006.01)
(Continued)

(52) U.S. Cl.
CPC ..... *B65B 43/465* (2013.01); *B65B 43/50* (2013.01); *B65B 43/60* (2013.01); *B65B 59/005* (2013.01); *B65B 65/02* (2013.01)

(58) Field of Classification Search
CPC ..... B65B 43/465; B65B 43/50; B65B 43/60; B65B 59/005; B65B 65/02
See application file for complete search history.

(56) References Cited

U.S. PATENT DOCUMENTS 5,845,466 A * 12/1998 Laudenberg ..... B65B 43/465 53/550
2007/0204570 A1 9/2007 Okazaki
(Continued)

FOREIGN PATENT DOCUMENTS

DE 4137961 A 5/1993
JP H08-156918 A 6/1996

OTHER PUBLICATIONS

Int'l Search Report and Written Opinion, PCT/EP2022/068282, Oct. 27, 2022 12 pages + 2 pages of translated search report.

*Primary Examiner* — Eyamindae C Jallow
(74) *Attorney, Agent, or Firm* — Kilpatrick Townsend & Stockton LLP

(57) ABSTRACT

Packaging bag receiving device for a packaging machine for receiving a plurality of packaging bags, comprising: a plurality of holder pairs for each holding a packaging bag, wherein each holder pair comprises a first holder and a second holder arranged at a predetermined distance therefrom, and wherein at least the first holder of a holder pair is displaceable with respect to the second holder of this holder pair; and a distance adjusting device for substantially simultaneously or concurrently adjusting the distances between the holders of each holder pair by displacing at least the first holder relative to the second holder of each holder pair.

19 Claims, 5 Drawing Sheets

(51) Int. Cl.

| | |
|---|---|
| ***B65B 43/50*** | (2006.01) |
| ***B65B 43/60*** | (2006.01) |
| ***B65B 59/00*** | (2006.01) |
| ***B65B 65/02*** | (2006.01) |

(56) References Cited

U.S. PATENT DOCUMENTS

| | | | | |
|---|---|---|---|---|
| 2010/0192524 | A1* | 8/2010 | Rapparini | B65B 31/024 53/284.7 |
| 2010/0281822 | A1* | 11/2010 | Murray | B65B 39/02 53/64 |
| 2015/0135651 | A1* | 5/2015 | Murray | B65B 43/32 53/384.1 |
| 2015/0217889 | A1* | 8/2015 | Nakamoto | B65G 17/323 198/678.1 |
| 2015/0274336 | A1* | 10/2015 | Kaneko | B65B 43/18 53/79 |
| 2017/0036792 | A1* | 2/2017 | Murray | B65B 43/36 |
| 2017/0100843 | A1* | 4/2017 | Yoshikane | B25J 15/0052 |
| 2018/0022484 | A1* | 1/2018 | Christophel | B65B 43/50 53/284.7 |
| 2018/0093787 | A1* | 4/2018 | Fukeda | B65H 5/14 |

* cited by examiner

PACKAGING BAG RECEIVING APPARATUS FOR A PACKAGING MACHINE, PACKAGING MACHINE AND METHOD

CROSS-REFERENCES TO RELATED APPLICATIONS

The present application is a 371 Application based on PCT Application No. PCT/EP2022/068282, filed Jul. 1, 2022, which claims priority and benefit from German Patent Application No. 10 2021 206 976.2, filed on Jul. 2, 2021.

The invention relates to a packaging bag receiving apparatus for receiving a plurality of packaging bags, a packaging machine comprising such a packaging bag receiving apparatus, and a method for adjusting the distances of a plurality of holder pairs of a packaging bag receiving apparatus.

Various methods for producing, filling and sealing packaging bags or corresponding packaging machines for producing, filling and sealing packaging bags are known. Two types of packaging machines are particularly common in the packaging industry: horizontal form, fill and seal machines (HFFS) and vertical form fill and seal machines (VFFS). These packaging machines and packaging methods differ in particular with regard to a substantial conveyance direction of the packaging material or the packaging bags produced. In an HFFS method, the packaging material and/or the packaging bag are conveyed substantially in a horizontal direction. In a VFFS method, the packaging material and/or the packaging bag are conveyed substantially in a vertical direction.

Depending on the filling material, shape and/or material of the packaging bags, different methods can be applied or different packaging machines can be used. It is particularly necessary to set up parts or sections of the packaging machines according to the packaging bags to be produced and filled. For example, the shape and/or material of packaging bags produced may vary between different products, batches and/or production cycles, such that one or more apparatuses of the packaging machine and/or process steps of the packaging method must be adjusted accordingly to ensure proper function. Some processes can be adjusted comparatively easily, for example using software, such as the amount of filling material to be filled into the packaging bags. Others require comparatively significant additional effort, for example setting up an apparatus for receiving and/or transporting the packaging bags produced. This requires, in particular, a positioning and/or alignment of holding or gripping elements adapted to the respective packaging bags, for example setting the correct distance between the holding or gripping elements in order to respectively hold or grip the packaging bags at a lateral edge region. Depending on the configuration and dimension of the packaging machine, this conversion process can involve a considerable amount of time, which results in a long downtime of the packaging machine, during which the packaging machine cannot be operated.

This applies in particular to HFFS packaging machines, which can have a so-called rotary machine, which can accommodate a plurality of packaging bags and transport them to different stations. In the case of such rotary machines, it is necessary to set up all receiving and holding apparatuses according to the packaging bags. This is usually done individually for each receiving or holding apparatus, which involves an increased amount of time and laborious changeover work. In addition, this procedure has an increased risk that not all receiving or holding apparatus are set correctly. However, incorrect setting of just one of the receiving or holding devices will result in a complete standstill of production, which causes considerable costs.

It is therefore an object of the present invention to provide a packaging bag receiving apparatus that allows for a reliable and easy setup of a plurality of receiving or holding apparatuses according to packaging bags to be received. In particular, it is an object of the present invention to reduce the changeover time of a packaging machine.

This object is solved by the subject matter of the independent claims. Advantageous embodiments are defined in the subclaims.

A first aspect of the invention relates to a packaging bag receiving apparatus for a packaging machine for receiving a plurality of packaging bags, comprising: a plurality of holder pairs for each holding a respective packaging bag, wherein each holder pair comprises a first holder and a second holder arranged at a predetermined distance therefrom, and wherein at least the first holder of a holder pair is displaceable with respect to the second holder of this holder pair; and a distance adjusting device for substantially simultaneously or concurrently adjusting or setting the distances between the holders of each holder pair by displacing at least the first holder relative to the second holder of each holder pair.

In other words, the packaging bag receiving apparatus comprises a plurality of holder pairs for each holding one packaging bag. Each of the holder pairs comprises a first holder and a second holder, which are arranged at a distance from one another and can each be brought into engagement with a packaging bag in order to hold it, wherein the distances between the respective first holder and the respective second holder of each holder pair can be adjusted to a predetermined value substantially simultaneously or concurrently according to the packaging bags to be held. In particular, the holders of each holder pair can be moved toward one another and away from one another.

Only a first holder or only a second holder of each holder pair can be designed to be displaceable. The respective non-displaceable holder is preferably arranged substantially fixedly or immovably relative to the packaging bag receiving apparatus. Alternatively, both the first holder and the second holder of each holder pair can be designed to be displaceable relative to one another and/or relative to the packaging bag receiving apparatus.

A substantially simultaneous or concurrent adjustment of the distance and/or a substantially simultaneous or concurrent displacement of at least one of the holders of the plurality of holder pairs allows for a reliable and time-saving conversion of the packaging bag receiving apparatus. The distance adjusting device is preferably configured to displace all first holders and/or all second holders of the plurality of holder pairs, so that the distances for the plurality of holder pairs, in particular for all holder pairs, can be adjusted simultaneously by said one distance adjusting device. Advantageously, the distances between the two holders can be adjusted to one another such that the two holders can grip and hold a bag together. In others, a variety of holders can be adjusted to a different bag size at the same time. With the bag gripped, the distances between the holders can be further changed if necessary to vary the bag opening. However, this change in distance, in particular for opening and/or closing a bag, is independent of the aforementioned simultaneous adjustment of the distances of the holders of the holder pairs. In addition, this change in distance can only take place with certain or selected holder pairs, independent of other holder pairs.

Preferably, the distance adjusting device is configured to displace the first holders and/or the second holders of all holder pairs substantially simultaneously or concurrently and substantially similarly or in unison. In this way, it can be ensures that all holder pairs be adjusted according to the packaging bags to be held. Here, all first holders are preferably mechanically coupled to one another such that all first holders are displaced substantially identically and simultaneously. Alternatively and/or additionally, all second holders are mechanically coupled to one another such that all second holders are displaced substantially identically and simultaneously. Within the meaning of this application, substantially similar or uniform displacement corresponds in particular to the fact that a plurality of holders are displaced in a substantially identical, commutated and/or similar manner with respect to their respective orientation and/or alignment and/or in relation to the respective holder pair and/or the packaging bag receiving apparatus. In particular, the holders are not necessarily displaced in the same direction with respect to an external coordinate system. For example, a substantially similar displacement of a plurality of holders of holder pairs arranged and/or aligned in a substantially point-symmetrical manner corresponds to a displacement of a holder substantially in the same direction and/or over the same distance relative to the respective holder pair, taking into account its alignment and/or orientation.

Alternatively and/or additionally, the distance adjusting device can be configured to displace the first holders and the second holders of all holder pairs substantially simultaneously or concurrently and substantially opposite to one another.

Preferably, the distance adjusting device is designed and coupled and/or mechanically connected to the first holders and the second holders of all holder pairs in order to displace all first holders in a first manner—relative to the respective holder pair—and to substantially simultaneously or concurrently displace all second holders in a second manner—relative to the respective holder pair—this manner being substantially opposite to the first manner. In other words: The displacement of the respective first holder and the respective second holder of the holder pairs takes place substantially symmetrically, in particular axially symmetrically. This makes it possible to adjust the distance by displacing the first and second holders such that the center point between the respective first holder and the second holder of a holder pair remains substantially unchanged when the distances are adjusted differently, i.e. the position thereof substantially does not change. This is particularly advantageous since, for example, it is not necessary to adapt the position of a filler neck or an introduction device for filling or introducing filling material into the packaging bag held by the holder pair.

Advantageously, the distance adjusting device is configured to adjust the distance between the first holder and the second holder of the holder pairs in accordance with the width of a packaging bag to be held.

A holder pair can in particular be designed to hold and/or grip a packaging bag at its lateral, upper edge region and/or at its upper corners. As a result, the packaging bag can be positioned in a manner substantially hanging on the holder pair. Furthermore, the distance between the first holder and the second holder of a holder pair is advantageously adjusted such that the packaging bag is held by them substantially without deformation and/or in a substantially flat state in accordance with its width. The predetermined distance between the respective first and second holders of all holder pairs is preferably selected and adjusted depending on the size and/or shape of the packaging bag. The distance to be adjusted can e.g. be between about 30 mm and about 500 mm, preferably between about 80 mm and about 400 mm, more preferably between about 160 mm and about 300 mm. In particular, the difference between a first distance to be adjusted and a second distance to be adjusted of one and the same packaging bag receiving apparatus can preferably be about 500 mm, more preferably about 300 mm, more preferably about 140 mm.

According to a preferred embodiment of the packaging bag receiving apparatus, the holder pairs are arranged substantially in accordance with the edges of a polygon, with each edge of the polygon preferably corresponding to a segment of the packaging bag receiving apparatus.

Such a preferred packaging bag receiving apparatus is particularly advantageous for an HFFS packaging machine and is known as a "rotary machine". Here, holder pairs are arranged substantially in a circle, preferably in accordance with edges of a polygon or polygon, for example a 4-gon, a 5-gon, a 6-gon, a 7-gon, an 8-gon, a 9-gon or a 10-gon. The holder pairs and the packaging bags held by them are preferably displaced or transported to various devices, for example pocket forming device, introduction device, testing device, labeling device and/or closing device by gradual and/or progressive rotation of the packaging bag receiving apparatus, and are preferably temporarily positioned there in a substantially stationary manner. In this way, a space-saving arrangement of the various devices of the packaging machine can be achieved. Furthermore, a plurality, in particular 2, 3, 4, 5 or more, holder pairs can be arranged on each edge of a polygon, i.e. on a segment of the rotary machine, so that a corresponding plurality of packaging bags can be arranged per segment.

In this preferred embodiment of the packaging bag receiving apparatus, the distance adjusting device is advantageously also configured to adjust the distances between holder pairs arranged on different edges of the polygon, i.e. on different segments, simultaneously or concurrently and/or similarly or in unison.

The packaging bag receiving apparatus advantageously has a plurality of, in particular 4, 5, 6, 7, 8, 9, 10, 12, 14, 16, 18, 20, 24, 30, 32, 40, 50 or more, holder pairs. A packaging bag receiving apparatus designed as a rotary machine and having 8 or 10 segments is preferred, with each segment having 4 or 5 holder pairs, as a result of which a high production capacity with yet a compact design is advantageously achieved.

Preferably, each holder of a holder pair has two holder elements, with at least one holder element being displaceable relative to the other holder element and each holder pair being configured to hold one packaging bag, preferably by bringing the holder elements of the holder into engagement with at least part of a packaging bag.

The holder pairs and/or holders can alternatively and/or additionally have other receiving or holding devices, for example one or more suction devices, to which a negative pressure and/or a vacuum can be applied in order to hold the packaging bag. The holder pairs and/or holders can also have one or more holding pins or hooks, with a packaging bag with corresponding openings being placed on them or suspended from them. Advantageously, the retaining pins or hooks can be retracted and/or displaced such that a packaging bag held by them can be ejected or released.

Further preferably, the packaging bag receiving apparatus is rotatably supported and configured for displacing and/or transporting held packaging bags, preferably along at least part of a substantially circular trajectory.

This is particularly advantageous in a packaging machine in which at least some devices, such as pocket forming device, introduction device, testing device, labeling device and/or closing device, are arranged substantially in a circle, as a result of which a space-saving design of the packaging machine can be achieved.

According to a further preferred embodiment, the packaging bag receiving apparatus is configured to displace and/or transport at least one packaging bag held by a selected holder pair to a pocket forming device. Furthermore, the distance adjusting device is advantageously configured for temporarily displacing at least one holder of the selected holder pair, in particular for temporarily reducing the adjusted distance between the holders of the selected holder pair, such that the packaging bag forms a pocket. Advantageously, the distance adjusting device is also configured to temporarily reduce the distances between all holder pairs of the same segment of the packaging bag receiving apparatus.

In order to enable, or at least facilitate, the filling or introduction of filling material or bulk material into a packaging bag held by a holder pair, it is advantageous to open and/or enlarge an opening in the packaging bag so that the packaging bag forms a pocket with an opening while being held by a holder pair. This can be done, for example, by adjusting a reduced distance between the holders of a holder pair, starting from the predetermined distance, in order to open and/or enlarge an opening of the packaging bag. The opening is preferably arranged substantially on a vertically upwardly oriented section of the packaging bag. The distance adjusting device for adjusting the distances between the plurality of holder pairs is preferably configured to reduce the distances of one or more selected holder pairs of the plurality of holder pairs independently of the other holder pairs. For example, the distance adjusting device comprises one or more actuating elements for selectively displacing at least one of the holders of one or more of the selected holder pairs for adjusting a distance between the holders, which is less than the predetermined and/or adjusted distance according to the size and/or shape of the packaging bag to be held. In particular, such an actuating element can act on one or more transmission elements of that transmission strand or those transmission strands that is configure to adjust a distance of the selected holder pair or that are configured to adjust a distance of the selected holder pair in order to achieve displacement of one or more holders of the selected holder pair or the selected holder pairs. A reduction in the distance of a selected holder pair or the distances of several selected holder pairs is preferably effected and/or maintained temporarily, more preferably at least while filling or introducing filling material or bulk material into the packaging bag. In other words: The forming of a pocket by the packaging bag is preferably effected at least for a period while the packaging bag is located in and/or below and/or in the area of an introduction device or filling device. It is particularly advantageous that after filling or introducing filling material into the packaging bag, the distance of the holders of the selected holder pair or the selected holder pairs be reset to the predetermined distance in accordance with the size and/or shape of the packaging bag. In this way, an advantageous closing of the packaging bag can be achieved following the pocket forming and/or filling of the packaging bag.

Advantageously, the distance adjusting device further comprises at least one transmission strand comprising one or more transmission elements for pulse transmission, in particular for simultaneous pulse transmission from a motion transmitter to at least one holder of the holder pairs. In particular, a pulse is to be understood as meaning a mechanical pulse, in particular a mechanical movement and/or an electrical pulse, in particular an electrical and/or electronic signal.

Preferably, a pulse is output and/or generated by a motion transmitter and transmitted to and/or forwarded to one or more holders via the one or more transmission strands.

The at least one transmission strand for pulse transmission is preferably designed and coupled to at least one holder of a holder pair in order to transmit a pulse from a motion transmitter to at least one holder of a holder pair and thus adjust the distance of a holder pair.

For example, at least part of a transmission strand can be designed to transmit a mechanical movement of a motion transmitter, for example a displacement, in particular a rotation and/or a translation, through one or more transmission elements to a holder or a plurality, for example two, three, four or more, in particular all holders of different holder pairs.

Alternatively and/or additionally, at least part of a transmission strand can be designed to forward and/or transmit a signal, in particular an electrical and/or electronic analog and/or digital signal, via one or more transmission elements. Preferably, a transmission strand comprises at least one actuator, which is designed to convert and/or transform a pulse in the form of a signal, for example an electrical signal, into a mechanical movement and to transmit it to one or more coupled transmission elements and/or holders. Examples of an actuator are an electric motor, a hydraulic or pneumatic actuator, a piezo actuator and/or a thermal actuator. In particular, an actuator is configured to generate a mechanical movement and can also be arranged at any position within a transmission strand.

Particularly preferably, the distance adjusting device has a motion transmitter that is coupled to a plurality, for example two, three, four or more, in particular all, transmission strands and/or transmission elements.

A motion transmitter can, for example, comprise an actuator that can be actuated by a machine and/or a person, in particular a handle, lever, knob, switch, button, valve and/or an adjusting screw. When an actuator is present in a transmission strand, a motion transmitter advantageously comprises a switch, button, controller in order to generate an (electrical and/or electronic) pulse and/or output it to the actuator. Alternatively and/or additionally, the motion transmitter is a control unit and/or the motion transmitter is comprised by a control unit, wherein the control unit is configured to control and/or regulate at least part of the packaging machine, in particular the packaging bag receiving apparatus. The control unit can be part of a computer-aided control unit of the packaging machine. The control unit can control and/or regulate the simultaneous adjustment of the distances. Optionally, the control unit can control or regulate the opening and/or closing of bags that have already been gripped, in particular as part of the filling process, i.e. control or regulate as part of a process movement of the holder pairs that is to be carried out repeatedly during operation of the packaging machine.

Alternatively and/or additionally, a pulse can be generated by one or more external motion transmitters and output and/or transmitted to the packaging machine, in particular to the packaging bag receiving apparatus, in particular to the distance adjusting device. Such an external motion transmitter can, for example, be an external control unit that is connected to the packaging machine and/or the packaging bag receiving apparatus and is configured to control and/or regulate it.

More preferably, a pulse, for example an analog and/or digital signal and/or a displacement of at least part of the motion transmitter, causes a substantially simultaneous or concurrent and substantially similar or uniform displacement of one or more transmission elements of the one or more transmission strands. The transmission elements are preferably each coupled to one or more holders of the holder pairs in order to displace them substantially simultaneously or concurrently and substantially similarly or in unison. Exemplary configurations of transmission strands, transmission elements and motion transmitters are described in exemplary embodiments in this application.

Preferably, each transmission strand is coupled to the motion transmitter and comprises a first rotation element that is coupled to the motion transmitter such that a pulse from the motion transmitter, in particular a displacement of at least part of the motion transmitter, causes a displacement, in particular a rotation, of the first rotation element; wherein the displacement of the first rotation element causes a displacement of the first holder of the holder pairs. The displacement of the at least one part of the motion transmitter as well as the displacement of the first rotation element is preferably carried out relative to the packaging bag receiving apparatus and/or relative to the holder pairs.

A packaging bag receiving apparatus with such a distance adjusting device advantageously has a compact design, since the first rotating element can be arranged on or at the packaging bag receiving apparatus in a space-saving manner. A corresponding distance adjusting device is also particularly advantageous for a packaging bag receiving apparatus with a plurality of holder pairs of a segment, i.e. which are arranged substantially in accordance with edges of a polygon and can be displaced in a substantially rotating manner (rotary machine). Preferably, the distance adjusting device further comprises one or more further transmission elements, which, for example, effect a substantially rotational displacement of the first rotation element into a preferably substantially linear displacement of one or more holders of a plurality of holder pairs.

Further preferably, the transmission strand further comprises: a second rotation element coupled to the motion transmitter such that a pulse from the motion transmitter, in particular a displacement of at least part of the motion transmitter, causes a displacement, in particular a rotation, of the second rotation element in a substantially opposite direction to the first rotation element; wherein the displacement of the second rotation element causes a displacement of the respective second holder of the holder pairs, preferably in a substantially opposite direction to the respective first holder.

This particularly preferred embodiment enables an advantageous displacement of both holders of a holder pair by opposing rotation of a first and a second rotation element. To this end, a motion transmitter designed and coupled to the first rotation element and the second rotation element so as to bring about an opposite rotation of the latter is particularly advantageous. Advantageously, an opposite rotation of a first and a second rotation element makes it possible to reduce, for example halve, the extent of the rotation of the two rotation elements to be carried out in order to achieve a certain extent of a change in distance—in comparison to a rotation to be carried out with only one rotation element. A further advantage is that a symmetrical design and/or opposite rotation ensures that a balance and/or a substantially symmetrical weight distribution is maintained. This is particularly preferred in order to achieve stable rotation of the packaging bag receiving apparatus at different adjusted distances of the holders.

According to a further advantageous embodiment of the packaging bag receiving apparatus, each transmission strand comprises: a cable pull and/or a push rod and/or a threaded rod and/or a spindle nut or movement nut and/or a gear and/or a rack and/or an actuator and/or a cable and/or a shaft. They are preferably each coupled to at least one holder in order to displace it relative to another holder of the same holder pair. Further preferably, each transmission strand of the distance adjusting device further comprises one or more transmission elements, which causes a displacement of at least one transmission element of one or more transmission strands into a preferably substantially linear displacement of one or more holders of a plurality of holder pairs. Alternatively and/or additionally, a transmission strand can have a gear, a lever, a deflection roller, a spring, a pin and/or similar element.

According to a further advantageous embodiment of the packaging bag receiving apparatus, each transmission strand of a plurality of transmission strands is configured to adjust a distance between the holders of a holder pair of the plurality of holder pairs, preferably by a substantially simultaneous or concurrent and substantially similar or uniform displacement of the at least one holder of the plurality of holder pairs.

This can advantageously achieve simultaneous and/or automated and/or motorized adjustment of the distances of a plurality of, preferably all, holder pairs. In particular, this enables a time-saving and simplified adjustment and/or conversion of the plurality of holder pairs.

Particularly preferably, respectively one transmission strand of the plurality of transmission strands is configured to adjust a distance between the holders of exactly one assigned holder pair of the plurality of holder pairs.

Alternatively, respectively one transmission strand of the plurality of transmission strands can be configured to adjust a plurality, for example two, holder pairs, wherein the holder pairs preferably have a substantially identical orientation and/or are arranged in the same segment of the packaging bag receiving apparatus and/or at the same station of a packaging machine. In particular, respectively one holder of two or more different holder pairs can be arranged on the same transmission element of a transmission strand, so that these holders are displaced similarly.

A further aspect of the invention relates to a packaging bag receiving apparatus for a packaging machine for receiving a plurality of packaging bags, comprising: a plurality of holder pairs for each holding a packaging bag, each holder pair comprising a first holder and comprising a second holder arranged at a predetermined distance therefrom, and wherein at least the first holder of a holder pair is displaceable with respect to the second holder of this holder pair; and a distance adjusting device for substantially simultaneously or concurrently adjusting the distances between the holders of each holder pair by displacing at least the first holder relative to the second holder of each holder pair; wherein one or more holder pairs of the plurality of holder pairs are arranged at different segments of the packaging bag receiving apparatus designed as a rotary machine, and wherein the packaging bag receiving apparatus is configured to change the distances of the holder pairs of a specific segment independently of the distances of the holder pairs of the other segments. Preferably, the packaging bag receiving apparatus comprises, for each holder pair or for each segment of the rotary machine, an actuator for adjusting the distance of an assigned holder pair or the distances of the holder pairs of the corresponding segment. More preferably, this actuator is configured to adjust the distance or distances simultaneously or concurrently to the other holder pairs. In addition, the same actuator is configured to adjust the distance or distances independently or separately from the other holder pairs, in particular as part of a process movement, for example for pocket forming of the held packaging bags.

A further aspect of the invention relates to a packaging machine for producing and/or filling and/or closing one or more packaging bags comprising the packaging bag receiving apparatus according to the first or second aspect of the invention.

A packaging machine preferably has a so-called VFFS or HFFS structure. Particularly preferably, the packaging machine comprises a roll of packaging material for forming or producing packaging bags. Advantageously, the packaging material is fed to the packaging machine by a feed device in a substantially horizontal transport direction (HFFS structure). More preferably, the packaging machine also has a shaping or folding device for (re)shaping and/or folding the packaging material.

Advantageously, the packaging machine comprises one or more, for example two, connecting devices for connecting two or more, in particular three or four, layers of packaging material in order to produce one or more packaging bags. Further preferably, the packaging machine comprises one or more, for example two, isolating devices for severing or (separating) or isolating one or more packaging bags from the band of packaging material. The packaging machine further comprises a packaging bag receiving apparatus according to the first aspect of the present invention, which is configured to receive one or more packaging bags produced by the packaging machine.

Preferred features and/or devices of a packaging machine as well as detailed descriptions thereof will be described in the exemplary embodiments in the figures.

A further aspect of the invention relates to a system comprising a packaging machine for producing and/or filling and/or closing one or more packaging bags according to one aspect of the invention and a motion transmitter, for example a regulating and/or control device, which is coupled to the packaging machine.

A further aspect of the invention relates to a method for substantially simultaneously or concurrently adjusting a predetermined distance of respectively a first holder and a second holder of a plurality of holder pairs, preferably all holder pairs, of a packaging bag receiving apparatus for receiving one or more packaging bags.

The method relates in particular to a packaging bag receiving apparatus according to the first aspect of the present invention. The method preferably includes adjusting a distance of holders of a plurality of, for example 4, 5, 6, 7, 8, 10, 12, 14, 16, 18, 20, 24, 30, 32, 40 or more, holder pairs, wherein the adjustment by a distance adjusting device takes place substantially simultaneously or concurrently and/or similarly or in unison.

Advantageously, the distance between the first holder and the second holder of the plurality of holder pairs is adjusted in accordance with the width of a packaging bag to be held in a resting or non-deformed state.

Further preferably, the method comprises a substantially similar or uniform and/or substantially simultaneous or concurrent displacement of at least one holder of the plurality of holder pairs by a distance adjusting device.

As a result, a substantially identical distance of the holders of the plurality of holder pairs, preferably all holder pairs, can advantageously be adjusted. In particular, a motion transmitter of the distance adjusting device and/or the packaging machine can be displaced such that one or more transmission strands, each with one or more transmission elements, are displaced such that a preferably linear displacement of one or more holders of a plurality of holder pairs is effected. In particular, a motion transmitter of the distance adjusting device and/or the packaging machine can transmit and/or forward a pulse to one or more transmission strands.

Further preferably, the method further comprises the steps of: engaging at least one holder pair with a packaging bag; and displacing, in particular rotating, the packaging bag receiving apparatus for displacing and/or transporting the at least one held packaging bag, preferably along at least a part of a substantially circular trajectory, wherein further preferably the plurality of holder pairs are arranged in accordance with different edges of a polygon, i.e. in different segments.

Preferably, one or more packaging bags are received by the packaging bag receiving apparatus. In particular, the holders of one or more holder pairs are each brought into engagement with a packaging bag, preferably connected to it in a detachable and/or substantially non-positive manner. Furthermore, the packaging bag receiving apparatus displaces the one or more packaging bags. Preferably, the packaging bag receiving apparatus transports the one or more packaging bags to one or more devices of a packaging machine, such as a pocket forming device, an introduction device and/or a closing device.

According to a preferred embodiment, the plurality of holder pairs are arranged substantially in accordance with the edges of a polygon, for example a 4-gon (tetragon), a 5-gon (pentagon), a 6-gon (hexagon), a 7-gon (heptagon), an 8-gon (octagon) or a 10-gon (decagon). More preferably, the packaging bags are displaced substantially by rotating the holder pairs around the center of the polygon. After the packaging bags have been transported to the filling device, the packaging bags are ejected or released, preferably by disengaging the holder from the respective packaging bag.

Advantageously, the method further comprises the step of: displacing a first holder of a selected holder pair with respect to a second holder of the same holder pair by the distance adjusting device for forming a pocket with the packaging bag while holding a packaging bag.

The pocket forming is preferably carried out before the respective packaging bag is filled. Advantageously, the distance adjusting device is configured to temporarily reduce or decrease the adjusted distance of one or more selected holder pairs of the plurality of holder pairs while holding a packaging bag. In this way, an opening in the packaging bag is enlarged in order to enable, or at least facilitate, the filling of filling material into the packaging bag.

In the following, individual embodiments for achieving the object will be described using the figures as examples. Here, the individual embodiments described partly include features that are not absolutely necessary to carry out the claimed subject matter, but which provide desired properties in certain applications. Embodiments that do not include all the features of the embodiments described below should also be viewed as being comprised by the technical teaching described. Furthermore, in order to avoid unnecessary repetition, certain features will only be mentioned in relation to individual embodiments described below. It should be noted that the individual embodiments should therefore not only be viewed individually, but also in conjunction. Based on this combined view, the person skilled in the art will recognize that individual embodiments can also be modified by incorporation of individual or multiple features of other embodiments. It is noted that a systematic combination of the individual embodiments with one or more features described in relation to other embodiments may be desirable and useful and should therefore also be considered as comprised by the description.

DETAILED DESCRIPTION OF THE DRAWINGS

Figure 1:
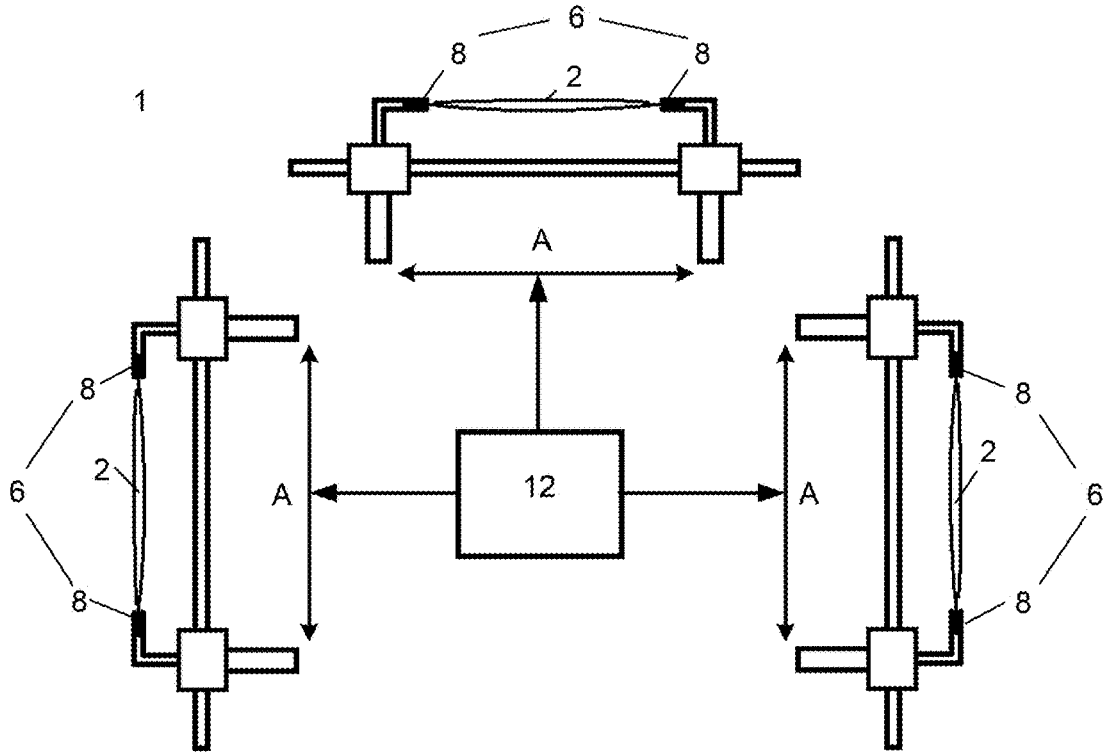
FIG. 1 shows a diagram of an exemplary packaging bag receiving apparatus with a plurality of holder pairs and a distance adjusting device for substantially simultaneous or concurrent adjustment of the distances of the holders of the plurality of holder pairs.

FIG. 1 shows a diagram of an exemplary packaging bag receiving apparatus 1 with a plurality, for example three, holder pairs 6 and a distance adjusting device 12 for substantially simultaneous or concurrent adjustment of the distances of the holders 8 of a plurality of holder pairs 6, preferably all holder pairs 6. The exemplary packaging bag receiving apparatus 1 shown in particular has a distance adjusting device 12 configured to displace at least one holder 8 of the plurality of holder pairs 6 in a preferably similar or uniform manner in order to adjust a specific distance A between the holders 8 of the respective holder pairs 6. Advantageously, the distance adjusting device 12 is mechanically and/or electrically/electronically coupled to at least one holder 8 of all holder pairs 6 comprised by the packaging bag receiving apparatus 1 so as to effect a simultaneous or concurrent and preferably similar or uniform displacement of at least one holder 8 of all holder pairs 6.

In order to adjust the plurality of holder pairs 6 to a specific distance A, a pulse is transmitted from a motion transmitter of the distance adjusting device 12 to at least one holder 8 of the holder pairs 6. For example, at least part of a motion transmitter of the distance adjusting device 12 is displaced such that at least one holder 8 of the holder pairs 6 is displaced. The distance adjusting device 12 is preferably designed and coupled to the first and second holders 8 of a plurality of holder pairs 6 such that the holders 8 are displaced substantially simultaneously to the left or right (or down or up) as shown in FIG. 1, so that the distances A between the first and second holders 8 of each holder pair 6 are increased or reduced in a substantially uniform manner.

The motion transmitter can be displaced manually or and/or (fully) automatically or mechanically. The displacement can be effected, for example, mechanically and/or electronically and/or hydraulically and/or pneumatically.

In the case of a (fully) automatic or mechanical distance adjusting device 12, the packaging bag receiving apparatus 1 is preferably configured to control and/or regulate the distance A. To this end, one or more sensors for measuring the distance A and/or the position of one or more holders 8 of one or more holder pairs 6 are particularly advantageous. Suitable sensors include, in particular, optical, acoustic, inductive and/or capacitive sensors as position sensors, displacement sensors, displacement transmitter and/or distance sensors. Alternatively and/or additionally, parameters, in particular position, alignment or orientation and/or distance, can be measured by one or more transmission elements 50' of a transmission strand 50 and/or a motion transmitter and fed to the control and/or regulation.

Optionally, one or more locking devices can be provided to substantially fix an adjusted distance. In particular, a position and/or orientation of one or more displaceable holders 8 and/or one or more motion transmitters and/or one or more transmission strands or their transmission elements can be substantially fixed or locked. This can be achieved, for example, by providing a split pin and/or a brake and/or a device that is configured to prevent displacement of one of said elements.

The features and properties mentioned can also be included in other packaging bag receiving apparatuses, in particular in the packaging bag receiving apparatuses described below.

Figure 2:
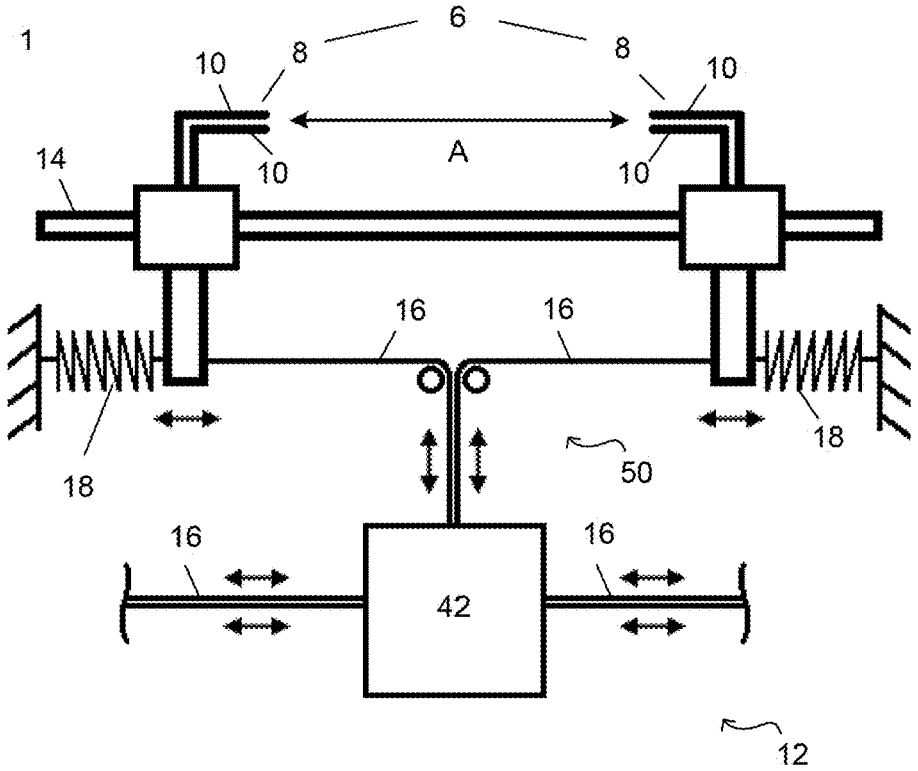
FIG. 2 shows an exemplary packaging bag receiving apparatus with a distance adjusting device, which is configured to adjust the distance between two holders of the plurality of holder pairs substantially simultaneously or concurrently by means of cable pulls.

FIG. 2 shows an exemplary packaging bag receiving apparatus 1 with a distance adjusting device 12 configured to adjust the distance A between two holders 8 of the plurality of holder pairs 6 substantially simultaneously or concurrently by means of cable pulls 16. The embodiment shown comprises a plurality of, for example three, substantially identical holder pairs 6 for receiving and/or holding a packaging bag 2. Both the first holder 8 and the second holder 8 of the holder pairs 6 are displaceable substantially linearly on or along a rail 14. To this end, a holder 8 can be attached to a carriage that can be moved along the rail 14.

The packaging bag receiving apparatus 1 shown comprises a distance adjusting device 12 configured to displace a plurality of transmission strands 50 or to transmit motion to one or more holders 8 by it. In the present example, each of the transmission strands 50 is coupled or mechanically connected to respectively one holder 8 of a holder pair 6.

Each of the transmission strands 50 has a cable pull 16, preferably a Bowden cable, comprising or consisting of a steel wire or wire rope, which is guided in a flexible but substantially pressure-resistant sheath in the pulling direction. As a result, pulses, in particular tensile forces, can be transmitted from a motion transmitter 42 to the holder 8 and the holder 8 can be displaced. Optionally, one or more restoring elements can be provided, for example a restoring spring 18, in order to displace one or more holders 8 in a direction opposite to a pulling direction transmitted by the cable pull 16 or to generate a counterforce.

A transmission strand 50 can include further transmission elements 50', such as deflection roller(s), connecting rod(s), (deflection) levers, gears and the like. In particular, the transmission strand 50 can include one or more transmission elements 50', which redirects or converts a first type or direction of displacement, for example a linear one, into a second type or direction of displacement, for example a rotational one. This enables a high degree of flexibility and individualization of the respective transmission strands. Furthermore, transmission strands 50 of a packaging bag receiving apparatus 1 can be designed at least partially differently. In particular, a mirror-image or symmetrical arrangement and/or operating mode of transmission strands of the first and second holders 8 of a holder pair 6 is advantageous, as shown in the exemplary packaging bag receiving apparatus 1 of Figure. 2. The holder 8 shown on the left is displaced to the right when the cable pull 16 is pulled in—the holder 8 shown on the right is displaced to the left substantially at the same time and/or in unison when the cable 16 is pulled in. Alternatively and/or additionally—if appropriate transmission elements are provided—the first holder 8 can be displaced individually or not substantially similarly to the second holder 8 of a holder pair 6.

The distance adjusting device 12 preferably has one or more motion transmitters 42. Alternatively, one or more external motion transmitters can be coupled to the packaging machine 20, in particular to the distance adjusting device 12. In this case, a motion transmitter can be mechanically and/or electrically coupled to a plurality, in particular one or more substantially identically designed groups, of transmission strands 50 of the packaging bag receiving apparatus 1.

For example, a motion transmitter can be coupled to a group consisting of two or more holders 8 of different holder pairs 6 in order to move them substantially at the same time and in unison. This enables a lower component cost and a lower complexity of the distance adjusting device 12 and is particularly advantageous if two or more holder pairs 6 have a substantially identical orientation, as shown, for example, in the embodiment of FIG. 4.

Alternatively, each motion strand 50 can have an actuator 62 configured to convert a pulse, in particular an electrical and/or electronic signal, from a motion transmitter 42 into a mechanical movement of the cable pull 16. In such an embodiment, the cable pulls 16 are preferably displaced substantially simultaneously or concurrently and substantially similarly or in unison, for example by appropriate control and/or regulation of the actuators 62, for example motors, in particular electric motors, by the motion transmitter 42, in order to ensure an advantageous identical and simultaneous adjustment of the distances of the holder pairs 6.

In the embodiment shown, both holders 8 of a holder pair 6 are displaceable. Alternatively, only one of the holders 8 of a holder pair 6 can be designed to be displaceable. The holders 8 can also be displaceable in other ways, for example rotationally.

Holders 8 within the meaning of this application preferably have two holder elements 10 that can be moved relative to one another. For example, a first holder element 10 is supported substantially stationary relative to the packaging bag receiving apparatus 1 and a second holder element 10 is designed to temporarily move away from the first holder element 10 so that a part of a packaging bag 2 can be positioned between the holder element 10. The second holder element 10 is then brought back to the first holder element 10 or brought into engagement with it and the packaging bag 2. Alternatively, both holder elements 10 of a holder 8 can be displaceable.

The distance adjusting device 12 shown can also be configured to at least temporarily change the distance A of one or more, for example two, selected holder pairs 6 of the plurality of holder pairs 6, independently of the rest of the plurality of holder pairs 6. This is in particular advantageous for forming a pocket by the packaging bags 2 held by the selected holder pairs 6, for example if the selected holder pairs 6 are located on and/or under and/or in a filling device and filling material is to be introduced into the packaging bag 2. Forming a substantially bulbous and/or pocket-shaped shape with an opening through the packaging bag 2 facilitates filling of the packaging bag 2.

For example, the packaging bag receiving apparatus 1 or the packaging machine 20 can have one or more motion transmitters, which can be coupled to one or more movement strands 50 such that they can effect a-preferably temporary-displacement of at least one of the holders 8 of one or more selected holder pairs 6. The packaging bag receiving apparatus 1 shown in FIG. 2 can, for example, have a motion transmitter that acts on one or more cable pulls 16 of one or more motion strands 50. In particular, a deflection of a cable pull 16 is advantageous, so that the holder 8 coupled to it is displaced and the distance between the first holder 8 and the second holder 8 of the associated holder pair 6 is reduced while a packaging bag 2 is held.

Figure 3:
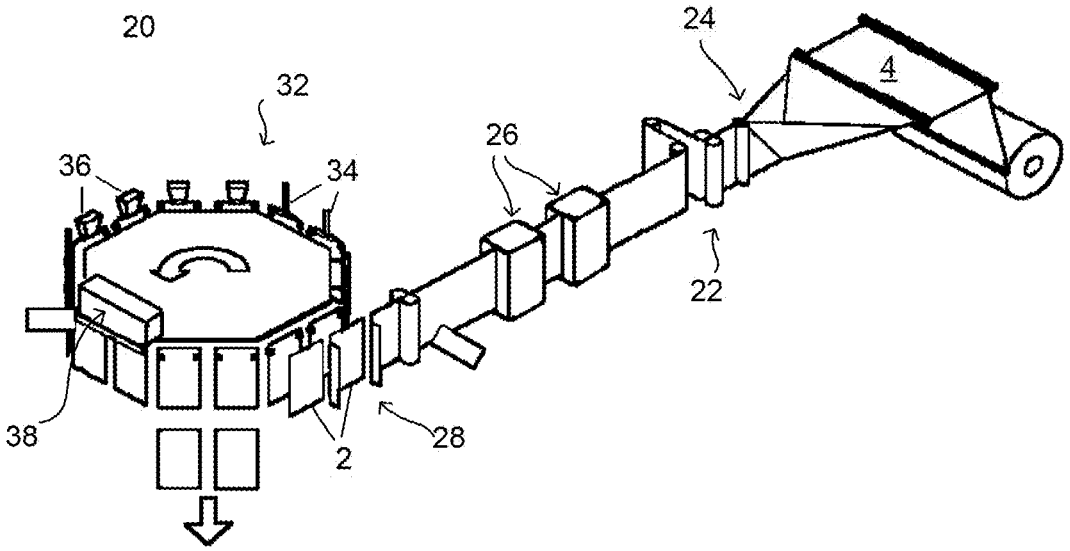
FIG. 3 shows an exemplary packaging machine for producing, filling and closing one or more packaging bags comprising a packaging bag receiving apparatus according to an aspect of the present invention.

FIG. 3 shows an exemplary packaging machine 20 that includes a packaging bag receiving apparatus 1 according to a preferred embodiment of the invention.

The packaging machine 20 has a so-called HFFS structure. The packaging machine 1 comprises a roll of a packaging material 4 for producing packaging bags 2. The packaging material 4 is fed to the packaging machine 2 by a feed device 22 in a substantially horizontal transport direction. In the embodiment shown, the feed device 22 comprises a pair of driven rollers or cylinders that transport or convey the packaging material 4. The packaging machine 20 shown also has a shaping or folding device 24 for (re) shaping and/or folding the packaging material 4. In the example shown, the forming or folding device 24 is configured to fold the packaging material 4 substantially in the middle to form a double band (comprising two layers) of the packaging material 4 with a fold or pleat along one side. In the exemplary embodiment shown, the feed device 22 is arranged downstream of the forming or folding device 24. Alternatively and/or additionally, the feed device 22 can be arranged upstream of the forming or folding device 24. Furthermore, the packaging machine 20 can have one or more additional feed devices 22 and/or forming or folding devices 24, wherein they can be arranged at different locations in the packaging machine 20.

As an alternative to the example shown, the packaging material 4 can be stocked in the form of individual pieces or sheets. In such an example, the feed device 22 and/or the forming or folding device 24 are preferably designed such that two or more, in particular three or four, pieces or sheets of the packaging material 4 are arranged and/or conveyed at least partially overlapping or lying one on top of the other.

The packaging machine 20 shown in FIG. 3 further comprises one or more, for example two, connecting devices 26 for connecting two or more, in particular three or four, layers of packaging material 4. Preferably, at least one of the connecting devices 26 is configured to create at least one, in particular two or three, connecting seams in or on at least part of the packaging material 4.

The one or more connecting devices 26 are preferably arranged downstream of a shaping or folding device 24 in the conveying direction of the packaging material 4. Alternatively and/or additionally, at least one connecting device 26 can be arranged upstream of a forming or folding device 24. A connecting device 26 can in particular be configured to create a connecting seam substantially orthogonal or transverse to the conveying direction of the packaging material 4. Alternatively and/or additionally, a connecting device 26 can be configured to create a connecting seam substantially parallel or longitudinal to the conveying direction of the packaging material 4.

In the exemplary packaging machine 20 shown in FIG. 3, the two connecting devices 26 are designed to produce packaging bags 2 by creating a respective connecting seam orthogonal or perpendicular to the conveying direction and/or the formed fold of the packaging material 4. In the packaging machine 20 shown, a plurality of packaging bags 2 are produced in this way on the strip of packaging material 4. Each packaging bag 2 is preferably formed by two adjacent or neighboring connecting seams and the section of packaging material 4 located between them. The packaging bags 2 also have an opening on the upper side opposite the fold.

The packaging machine 20 of FIG. 3 comprises one or more, for example two, separating devices 28 for separating or severing or isolating one or more packaging bags 2 from the strip of packaging material 4. In the example shown, the separating device 28 comprises two separating tools, for example a knife or blade or cutting edge, which are configured to cut or sever at least part of the packaging material 4. In the exemplary embodiment of the packaging machine 20 shown, the separating device 28 is configured to separate a respective area of the packaging material 4, which forms a packaging bag 2.

In the present, exemplary embodiment, the packaging machine 20 comprises a rotary machine 32 as a packaging receiving device 1 for receiving and/or transporting or conveying one or more packaging bags 2 and/or separated sections of the packaging material 4. The rotary machine 32 is preferably configured to feed one or more packaging bags 2 and/or separated sections of the packaging material 4 substantially continuously or intermittently to one or more stations or devices of the packaging machine 2, in particular to a filling device of the packaging machine 20 for filling the packaging bags 2, preferably with bulk material. The filling device advantageously has an opening device and/or pocket forming device 34 for opening the opening of the packaging bag 2 and/or shaping the packaging bag 2, in particular by forming a substantially bulbous pocket—in preparation for filling the packaging bag 2. One or more, e.g. two, three or four introduction devices 36 are configured to fill the packaging bags 2 with one or more items, in particular with bulk material, and/or with one or more fluids.

As shown in FIG. 3, the rotary machine 32 is preferably configured to transport or convey the packaging bags 2 along a substantially circular path to one or more stations or devices of the packaging machine 20, in particular the filling device. Preferably, the packaging bags 2 can temporarily remain substantially stationary in one or more of the devices The packaging machine 20 further has one or more, in particular 2 or 3, closing devices 38 for closing one or more, for example two, packaging bags 2. In the present example, two filled packaging bags 2 are fed to a closing device 38 and closed by it. A closing device 38 is preferably configured to close the opening of a packaging bag 2, in particular by connecting a packaging material 4 forming the opening. The closing device 38 preferably comprises one or more embossing tools for creating at least one connecting seam for closing the opening of the packaging bag 2. The closing device 38 can be designed to be substantially stationary or displaceable with respect to the one or more packaging bags 2. Particularly advantageous is a closing device 38 that can be moved substantially parallel to or along the side of the packaging bag 2 that includes the opening. Alternatively and/or additionally, the closing device 38 can be configured to apply an adhesive to close the opening. It is particularly advantageous to close the opening using cold glue or a similar cold-bonding adhesive.

The produced, filled and closed packaging bag 2 is then led out of the packaging machine 20. Furthermore, the packaging machine 20 optionally has one or more control devices for checking or inspecting in particular the packaging material 4 and/or a connecting seam. Conveying or feeding of the packaging material 4 and/or the packaging bags 2 can in particular be carried out substantially intermittently or continuously. In particular, conveying can vary in the individual stations or sections of the packaging machine 20. As shown in the example of FIG. 3, the packaging material 4 is preferably transported or conveyed substantially continuously, i.e. at a substantially constant speed, in particular without acceleration, at least up to a separating device 28.

Packaging bags 2 within the meaning of this application in particular have packaging material 4 comprising plastics, such as polypropylene (PP), polyethylene (PE), polystyrene (PS) or polyethylene terephthalate (PET). Alternatively and/or additionally, packaging bags 2 can comprise packaging material 4 consisting at least partially of fibrous material, in particular cellulose, wood pulp and/or paper, in particular waste paper pulp.

Furthermore, packaging bags 2 within the meaning of this application are particularly suitable for holding bulk material and/or fluids. Bulk material is understood to mean, for example, a substantially powdery, grainy, granular and/or lumpy mixture, which is preferably in pourable form. Likewise, bulk material within the meaning of this application includes so-called loose goods, i.e. substantially pourable, definable or quantifiable units, such as hardware or assembly accessories (e.g. screws, nuts, nails, washers, felt gliders and the like.), craft and sewing materials (e.g. beads, (snap) buttons, sequins and the like), stationery (e.g. paper clips and the like), toys (e.g. building blocks, game figures, dice and the like), and preferably dry food (e.g. biscuits, cereals/muesli, coffee, rice, pasta, sugar, salt and the like). Alternatively and/or additionally, packaging bags may be suitable for holding a single item, such as a connecting cable, a hand tool or the like.

Figure 4:
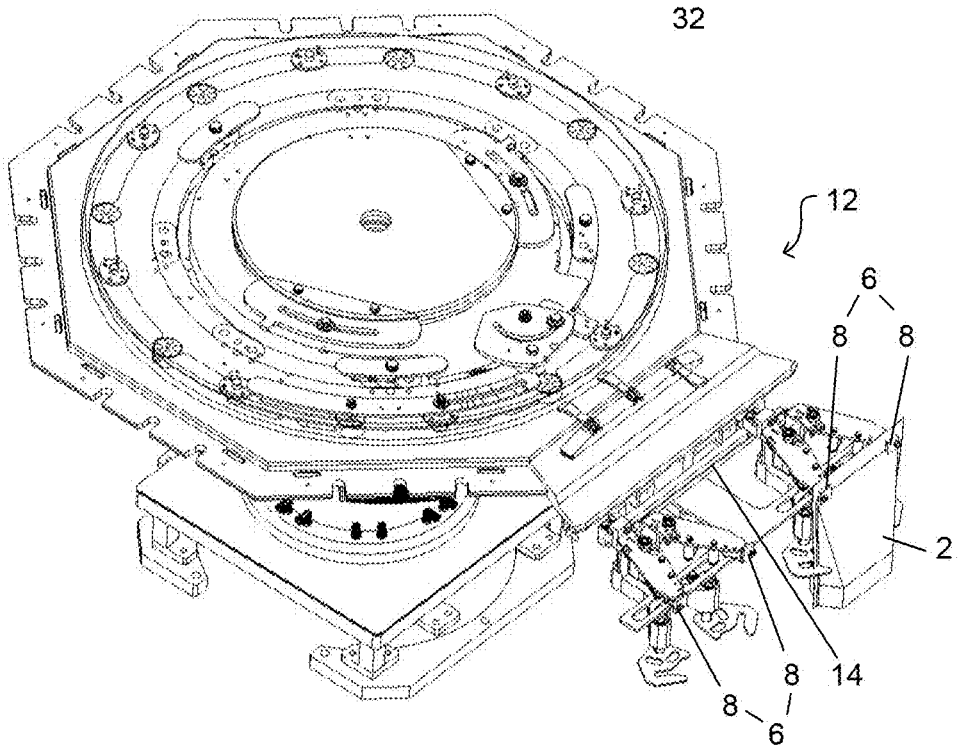
FIG. 4 shows a further exemplary packaging bag receiving apparatus with a distance adjusting device, which is configured to adjust the distance between two holders of the plurality of holder pairs by means of rotation elements that can be rotated relative to one another.

FIG. 4 shows a further exemplary packaging bag receiving apparatus 1 with a distance adjusting device 12, which is configured to adjust the distance between two holders 8 of a plurality of holder pairs 6 by means of rotation elements 40*a*, 40*b* that can be rotated relative to one another. The packaging bag receiving apparatus 1 is designed as a rotary machine 32 in this embodiment. The rotary machine 32 is configured to be rotated in order to transport packaging bags 2 to different devices of a packaging machine 20, as described with respect to FIG. 3.

The rotary machine 32 has an octagonal, rotatable platform, on the edges of which two holder pairs 6 are arranged for receiving and/or holding packaging bags 2. As an alternative to the example shown, the platform can also have a different shape, in particular it can be a 4-gon, 5-gon, 6-gon, 7-gon, 9-gon or 10-gon. Likewise, only one or three or five or more holder pairs 6 can be arranged on one edge, i.e. on a segment, of the platform.

Figure 5:
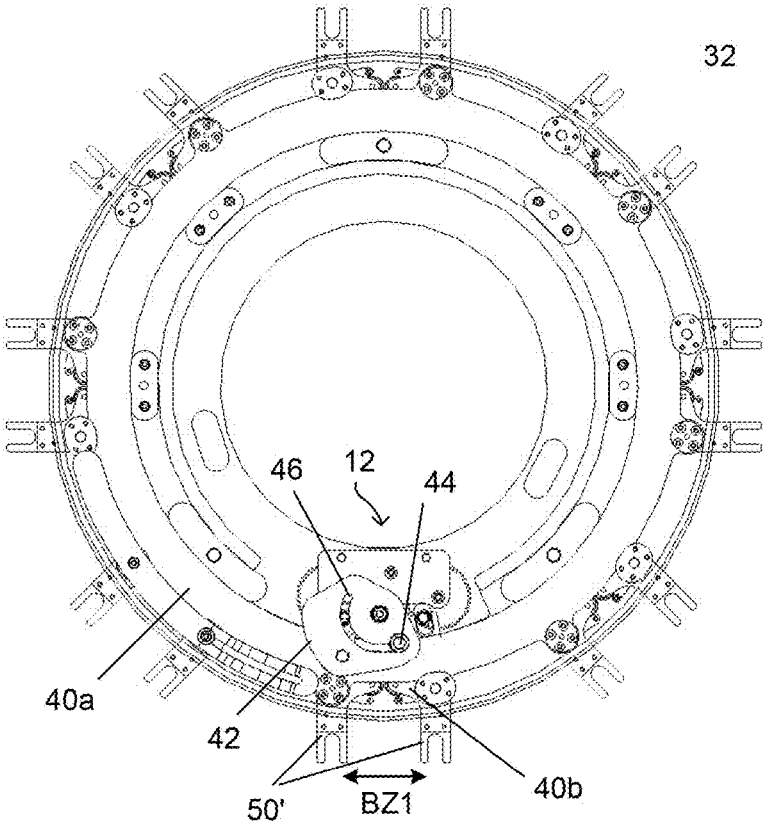
FIG. 5 shows the exemplary packaging bag receiving apparatus of FIG. 4 in a first operating mode, in which the holders are adjusted to a first distance.
Figure 6:
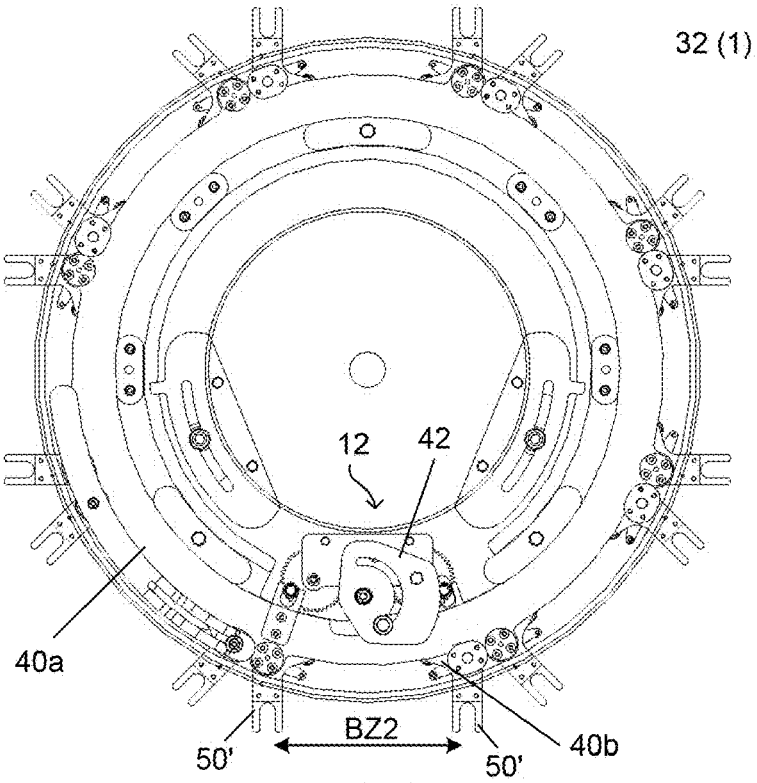
FIG. 6 shows the exemplary packaging bag receiving apparatus of FIG. 4 in a second operating mode, in which the holders are adjusted to a second distance that is greater than the first distance in the first operating mode.

As shown in particular in FIGS. 5 and 6, the distance adjusting device 12 of the exemplary packaging bag receiving apparatus 1 comprises a rotatable motion transmitter 42. Alternatively, the adjustment device 12 is coupled to an external motion transmitter 42. The exemplary motion transmitter 42 is coupled to first and a second transmission strands 50, as a result of which a pulse from the motion transmitter 42 is transmitted and/or output to the first and second transmission strands 50. The first transmission strand 50 comprises the first rotation element 40*a*, which is rotatably displaceable relative to the packaging bag receiving apparatus 1. It is coupled or mechanically connected to the motion transmitter 42 such that a displacement, in particular a rotation, of the motion transmitter 42 causes a displacement, in particular a rotational displacement, of the first rotation element 40*a*.

The second transmission strand 50 comprises the second rotation element 40*b*, which is rotatably displaceable relative to the packaging bag receiving apparatus 1. It is coupled or mechanically connected to the motion transmitter 42 such that a displacement, in particular a rotation, of the motion transmitter 42 causes a displacement, in particular a rotational displacement, of the first rotation element 40*b*.

Displacing the motion transmitter 42 preferably causes a substantially opposite displacement, in particular rotation, of the first rotation element 40*a* relative to the second rotation element 40*b*.

Advantageously, the first rotation element 40*a* is coupled to further transmission elements 50' such that a displacement of the first rotation element 40*a* causes a displacement of one or more transmission elements 50'. Further preferably, the second rotation element 40*b* is also coupled to further transmission elements 50' in order to displace them.

The distance adjusting device 12 is designed to bring the packaging bag receiving apparatus 1 into two or more operating states, with operating states corresponding to different distances A of the holders 8 of a plurality of holder pairs 6. FIGS. 5 and 6 show the exemplary packaging bag receiving apparatus of FIG. 4 in a first operating mode BZ1 and in a second operating mode BZ2, the first operating mode BZ1 being set for a packaging bag in a first size and/or shape and the second operating mode BZ2 being set for a packaging bag with a second size different from the first size.

The motion transmitter 42 of the exemplary embodiment shown is supported on the packaging bag receiving apparatus 1 in a substantially rotatable manner. The motion transmitter 42 further has a groove 46 that substantially describes a radius around the center of rotation of the motion transmitter 42. Furthermore, a pin 44 is movably arranged in the groove 46 and connected to the packaging bag receiving apparatus 1.

In the example shown, the second rotation element 40*b* is arranged below the first rotation element 40*a* and is partially covered by it in the figure. The two rotation elements 40*a*, 40*b* are connected to the motion transmitter 42 via one or more coupling members and/or one or more gears such that-starting from the first operating state BZ1 in FIG. 5—a counterclockwise rotation of the motion transmitter 42 results in a clockwise rotation of the first rotation element 40*a* and a counterclockwise rotation of the second rotation element 40*b* substantially simultaneously or concurrently. In the second operating state BZ2 of the packaging bag receiving apparatus 1, the distances between the radially projecting transmission elements of the respective transmission strands 50 assigned to the first and second holders 8 are larger than in the first operating state BZ1.

The radially projecting transmission elements 50' can each be coupled to a single holder 8 or—as shown in FIG. 4—be coupled to two or more, for example two, holders 8 via one or more further transmission elements and preferably cause a substantially identical or at least commutated displacement of the one or more holders 8.

As an alternative to the packaging bag receiving apparatus 1 shown, only one rotation element can also be provided, so that only the first holder 8 of the holder pairs 6 is displaced. Furthermore, transmission elements and/or coupling members can have a cable pull 16, connecting rod, lever, push rod 54, threaded rod 60 and similar elements, which are suitable for a desired, advantageous transmission and/or redirection of a motion of one or more motion transmitters to one or more holders.

The packaging material receiving device 1 shown can also be configured to at least temporarily deform one or more held packaging bags 2 such that they form a substantially bulbous bag. Preferably, a motion transmitter causes a displacement of one or more transmission elements of one or more transmission strands 50 of one or more, for example two, selected holder pairs 6. Advantageously, the motion transmitter is coupled to form a pocket with one or more transmission elements, which are arranged between the radially projecting transmission elements shown in FIGS. 5 and 6 and holder pairs 6 coupled to them—as shown in FIG. 4. It is also advantageous that a displacement of one or more transmission elements by the motion transmitter for pocket forming does not cause a displacement of the one or more rotation elements 40*a*, 40*b*, so that only the selected holder pairs 6 are acted upon.

Figure 7:
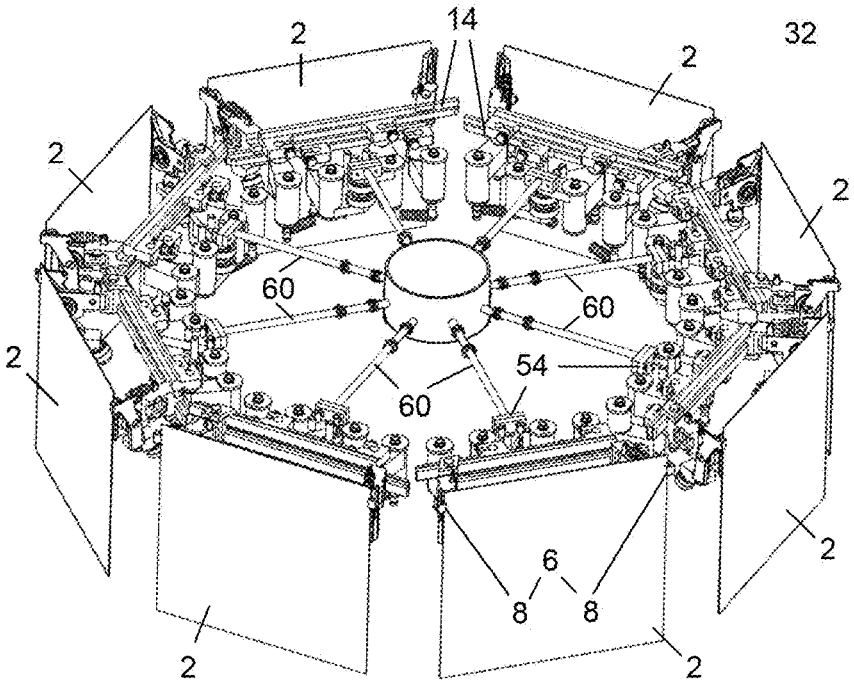
FIG. 7 shows a further exemplary packaging bag receiving apparatus, which is configured to adjust the distance between two holders of the plurality of holder pairs by means of a plurality of threaded rods.

FIG. 7 shows a further exemplary embodiment of the packaging bag receiving apparatus 1, which is configured to adjust the distance between two holders 8 of a plurality of holder pairs 6 by means of a plurality of threaded rods 60. In this example, the packaging bag receiving apparatus 1 is designed as an octagonal rotary machine 32. The rotary machine 32 shown comprises eight holder pairs 6—i.e. one holder pair 6 per segment—for receiving and/or holding up to eight packaging bags 2. The holders 8 of the holder pairs 6 are each arranged on rails 14 so that they are displaceable in a substantially straight or linear manner.

The example shown in FIG. 7 preferably comprises a distance adjusting device 12 configured to displace all holders 8 of all eight holder pairs 6 substantially simultaneously or concurrently in order to adjust the distances A of the holder pairs 6 substantially simultaneously and identically. The distance adjusting device 12 preferably comprises a motion transmitter 42 arranged substantially centrally in the rotary machine 32 and a plurality of transmission strands 50 for displacing the holders 8. According to the example, a threaded rod 60 is provided per one holder pair 6, which are arranged substantially in a star shape and extend from the center of the packaging bag receiving apparatus 1 radially outward to respectively one holder pair 6. In the example shown, the packaging bag receiving apparatus 1 has eight holder pairs 6 and eight threaded rods 60. The threaded rods 60 are preferably coupled to further transmission elements such that a rotation of the threaded rods 60 causes a displacement of the holders 8 of the holder pairs 6, preferably substantially perpendicular to the longitudinal axis of the threaded rods 60.

For example, a rotation of the threaded rods 60 in a first direction causes the holders 8 to move apart, so that the distance A is increased. Conversely, a rotation of the threaded rods 60 in a second direction causes the holders 8 to come together, so that the distance A is reduced. By providing one or more different transmission elements, the translation and also the type of motion transmission and/or deflection can be advantageously set and/or adjusted. The following are particularly suitable for this: lever, cable pull, deflection pulley, connecting rod, eccentric, etc.

The threaded rods 60 can be supported in a rotatable and substantially stationary manner with respect to the rotary machine 32. A rotation of the threaded rods 60 preferably causes a, in particular linear, displacement of one or more coupled transmission elements, for example in the form of a spindle nut or movement nut 54, which is threaded onto the threaded rod 60. Here, a rotational movement of the threaded rod 60 is converted into a substantially linear movement. The spindle nut or movement nut 54 is coupled to the holders 8 of a holder pair 6, so that a displacement of the spindle nut or movement nut 54 causes a displacement of the holders 8.

More preferably, the first holder 8 of the holder pairs 6 is displaced in the opposite direction to the displacement of the second holder 8 of the holder pairs 6. In other words: a rotational movement of the threaded rod 60 causes—depending on the direction-the two holders 8 of a holder pair 6 to be brought together or moved apart, as a result of which the distance A of the holder pair 6 can be adjusted.

Preferably there is provided a motion transmitter 42 that is coupled to the eight threaded rods 60 and is configured to transmit and/or output a pulse to the transmission strands 50, so that the eight threaded rods 60 rotate substantially simultaneously or concurrently and substantially similarly or in unison. For example, a motion transmitter 42 can have a central gear that can be driven by a motor and/or manually. Alternatively, each of the transmission strands 50 can have an actuator 62 that receives a signal from a motion transmitter 42 and converts it into a mechanical movement of the respective threaded rods 60.

The motion transmitter 42 can be formed integrally with the packaging bag receiving apparatus 1 and/or the packaging machine 20 or can be provided externally and coupled to the packaging bag receiving apparatus 1 and/or the packaging machine 20, for example in the form of an external control and/or regulating device.

Figure 8:
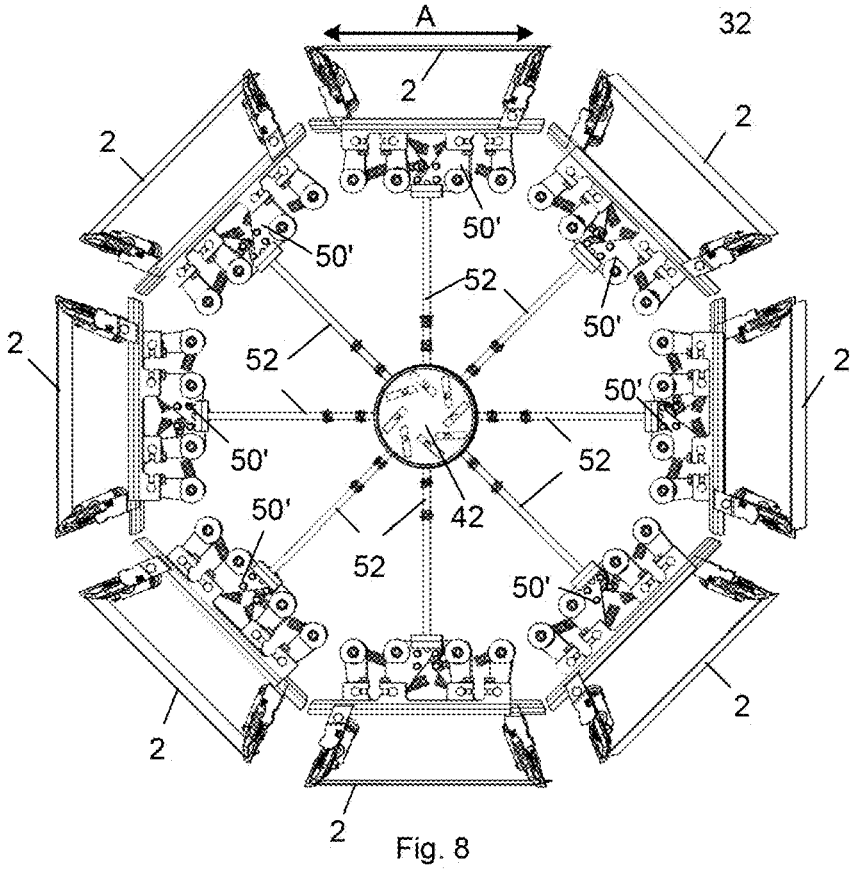
FIG. 8 shows an alternative embodiment of the packaging bag receiving apparatus of FIG. 7, wherein the distance between holders is adjustable by means of a plurality of pressure rods.

FIG. 8 shows a further exemplary packaging bag receiving apparatus 1, which has a similar structure to the embodiment of FIG. 7, but is configured to adjust the distance between two holders 8 of the plurality of holder pairs 6 by means of a plurality of pressure rods 52. According to the example, one push rod 52 is provided for each holder pair 6, which are arranged substantially in a star shape and extend from the center of the packaging bag receiving apparatus 1 radially outward to one holder pair 6 each. The push rods 52 are preferably coupled to further transmission elements 50' such that a substantially linear movement or linear displacement of the push rods 52 causes the holders 8 of the holder pairs 6 to be displaced substantially perpendicular to the longitudinal axis of the push rods 52. For example, a movement of the push rods 52 radially outward causes the holders to move apart, so that the distance A is increased. Conversely, a movement of the push rods 52 radially inward causes the holders to come together, so that the distance A is reduced.

In the example shown, there is provided a motion transmitter 42 that is rotatably displaceable and is coupled to the eight push rods 52 and is configured to displace the eight push rods 52 substantially simultaneously or concurrently and substantially similarly on in unison, in particular in their longitudinal direction and/or in the radial direction of the packaging bag receiving apparatus 1. Each push rod 52 preferably has a bolt and/or pin 44 at its central end, which is movably arranged in a groove 46 of the motion transmitter 42. A suitable shape of the groove causes a rotational movement of the motion transmitter 42 to be redirected to a linear movement of the push rods 52.

The packaging bag receiving apparatuses 1 of FIGS. 7 and 8 are preferably further configured to change the distance of one or more selected holder pairs 6 separately or independently of the remaining holder pairs 6. This is particularly advantageous for forming a bag using the packaging bags 2 held by the selected holder pairs 6, in particular to make filling thereof easier. The packaging bag receiving apparatuses 1 or the packaging machine 20 advantageously have one or more additional motion transmitters, in particular pocket shape motion transmitters, which are coupled to one or more transmission elements of the one or more selected holder pairs 6 so as to their distance A at least temporarily and independently of the non-selected holder pairs 6.

In particular, one or more integral and/or external additional motion transmitters, in particular pocket shape motion transmitters, can be provided and/or arranged in a substantially stationary manner with respect to the packaging bag receiving apparatus 1 so that it/they can only act on one or more holder pairs 6 with a specific orientation and/or of a specific segment. By moving, in particular rotating, the holder pairs 6, selected holder pairs 6 and/or holder pairs having a specific orientation and/or holder pairs of a specific segment can be coupled to the one or more additional motion transmitters, in particular pocket shape motion transmitters.

Figure 9:
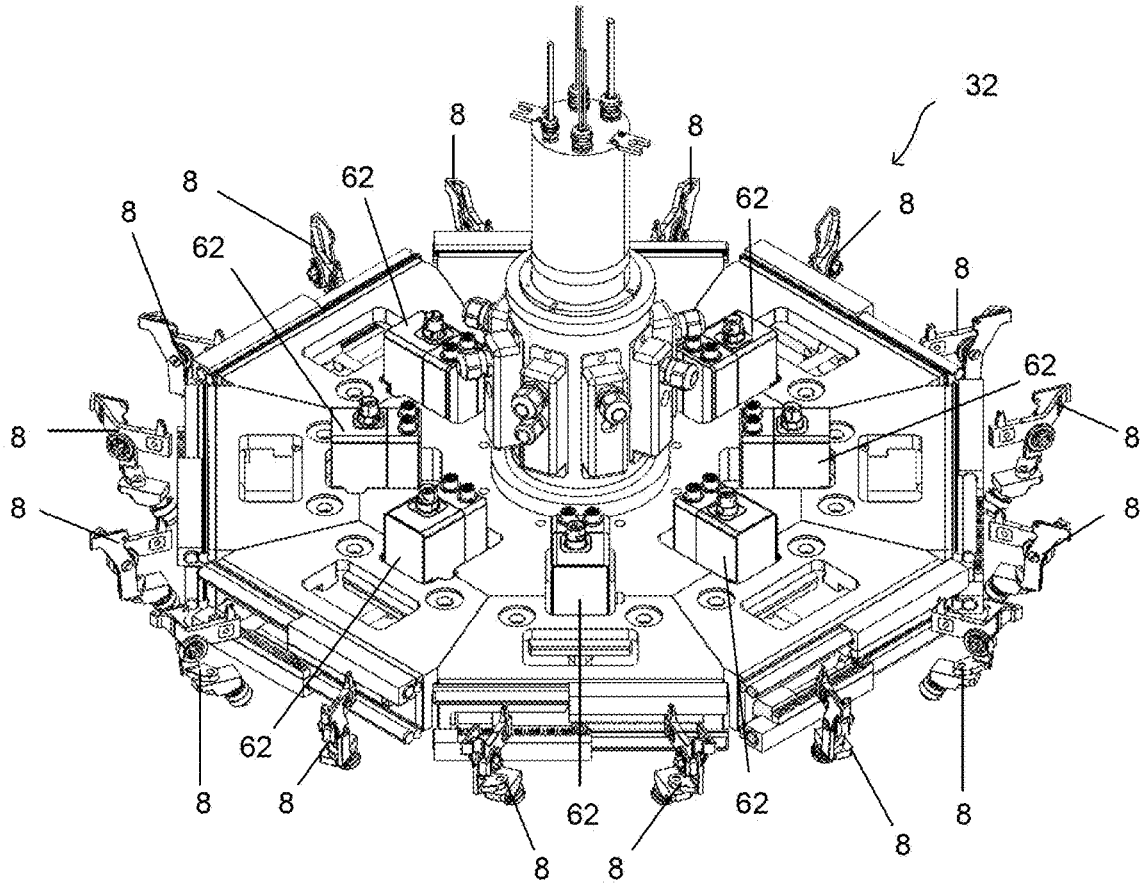
FIG. 9 shows a further exemplary packaging bag receiving apparatus, which has a plurality of transmission strands, each with an actuator.

FIG. 9 shows a further exemplary packaging bag receiving apparatus 1, which has a plurality of transmission strands 50, each with an actuator 62. The packaging bag receiving apparatus 1 is advantageously designed as a rotary machine 32. The rotary machine 32 shown comprises a plurality, for example six, eight or ten, holder pairs 6, each of the holder pairs 6 being coupled to a motion transmitter 42 (not shown) via a respective transmission strand 50. The motion transmitter 42 can be formed integrally with the packaging bag receiving apparatus 1 or the packaging machine 20 or can be provided externally and coupled to the packaging bag receiving apparatus 1 and/or the packaging machine 20.

This embodiment makes it possible, in particular, to adjust the plurality of holder pairs 6 substantially simultaneously or concurrently and similarly or identically. To this end, the actuators 62 of each transmission strand 50 are preferably controlled substantially simultaneously and/or identically or a pulse is transmitted to them, so that one or more transmission elements of the respective transmission strand 50 and holders 8 coupled thereto are displaced. In this way, a simple, time-saving and/or tool-free adjustment of the distances of the plurality of holder pairs 6 of the packaging bag receiving apparatus 1 is made possible.

Each of the actuators 62 is connected to the motion transmitter 42 (not shown) preferably via one or more electrical lines and/or cables, so that a pulse generated and/or output by the motion transmitter 42, in particular an electrical and/or electronic signal, can be received by the actuators 62. For example, the motion transmitter 42 comprises one or more controllers and/or buttons and/or switches for generating a signal, in particular a signal comprising one or more electrically and/or electronically modulated information, for controlling and/or regulating the actuators 62. Alternatively and/or or additionally, a motion transmitter 42 can be provided in an external control and/or regulating device and coupled to the one or more transmission strands 50.

Figure 10:
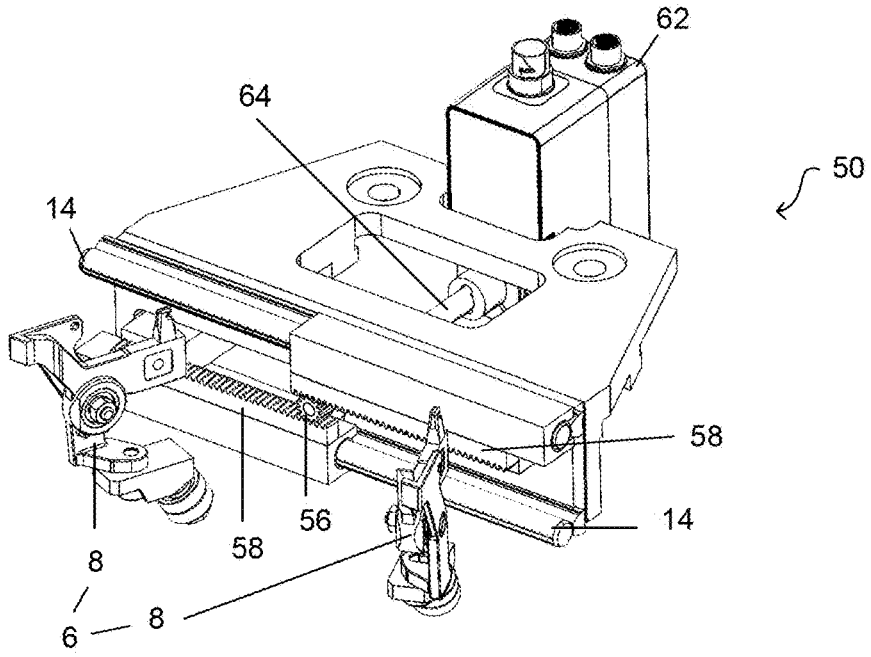
FIG. 10 shows a holder pair and a transmission strand of the distance adjusting device according to the example of a packaging bag receiving apparatus of FIG. 9.

FIG. 10 shows a holder pair 6 and part of a transmission strand 50 of the distance adjusting device 12 according to the example of a packaging bag receiving apparatus 1 of FIG. 9, with the part of the transmission strand 50 shown being configured to convert an electrical and/or electronic pulse, such as an electrical and/or electronic signal, into a mechanical pulse, such as a mechanical movement, and transmit it to the holder 6.

At least one holder 8 of each holder pair 6 is arranged displaceably, for example along a guide and/or rail 14. As a result, the holder pairs 6 are each configured to enable both movements for adjusting the distance for a bag of a certain size and cyclical, i.e. to be carried out repeatedly during operation of the packaging machine 1, movements (referred to as process movements in the context of the entire present description), in particular for opening, closing and/or tightening a held packaging bag 2. In this way, no additional devices need to be provided for carrying out process movements. For the process movements, only one or more specific actuators 62 can be controlled, which are also suitable for adjusting the predetermined distances A adapted to the packaging bags 2. In particular, the packaging bag receiving apparatus 1 shown is configure to displace only those holder pairs 6 that are positioned at a specific station of the packaging machine 1.

The packaging machine 20 preferably comprises a control unit and/or is coupled to an external control unit, which controls and/or regulates the operation of at least part of the packaging machine 20, in particular the packaging bag receiving apparatus 10. In particular, such a control unit is configured to output pulses, in particular electrical and/or electronic signals, only to one or more specific or selected holder pairs 6 in order to displace them independently or separately from other holder pairs 6.

This is particularly advantageous for forming a pocket using the packaging bags 2 held by the selected holder pairs 6, in particular to make filling thereof easier. The control unit is advantageously configured to temporarily and independently displace those holder pairs 6 that are located on a pocket forming device, introduction device and/or testing device of a rotary machine 32.

Advantageously, at least one holder 8 of a holder pair 6 is arranged on a displaceable transmission element, for example in the form of a rack 58, in order to receive a pulse, in particular to experience a mechanical movement. Preferably, the rack 58 is movably supported along a rail 14, so that the distance between the holders 8 of a holder pair 6 can be changed by moving the rack 58. More preferably, a gear 56 is coupled to the rack 58 such that a rotation of the gear 56 causes a, in particular translational, displacement of the rack 58 and the holder 8.

In the example shown, the gear 56 is coupled to an actuator 62 via a shaft 64. The actuator 62 is connected and/or coupled (not shown) to an integrated and/or an external motion transmitter 42 via one or more electrical lines in order to receive a pulse from the motion transmitter 42. The actuator 62 is configured to convert and/or transform a received electrical and/or electronic pulse into a mechanical movement of the shaft 64. A preferred example of an actuator 62 is in particular an electrical and/or electromechanical actuator, which is suitable for controlling and/or regulating the distance of the holders 8, such as an electric motor, in particular a servo motor.

In such an embodiment, a plurality of actuators 62, in particular electric motors, can be controlled by means of a motion transmitter 42 (not shown), for example comprising a controller and/or button and/or switch, such that the majority, preferably all, of holder pairs 6 can be displaced and adjusted to a specific bag size substantially simultaneously and in unison. The motion transmitter 42 may be formed integrally with the packaging bag receiving apparatus 1 or the packaging machine 20 or may be provided externally and coupled to the packaging bag receiving apparatus 1 or the packaging machine 20.

Both holders 8 of a holder pair 6 are advantageously arranged on a displaceable rack 58, in particular such that both holders 8 of the holder pair 6 can be displaced in substantially opposite directions by rotating the gear 56.

The transmission strand 50 shown in FIG. 10 corresponds to an exemplary embodiment. Alternatively and/or additionally, a transmission strand 50 can be designed differently. For example, one or more transmission elements of the transmission strand 50 can be designed to be pivotable and/or oscillating and/or displaceable in some other way in order to transmit a movement to one or more transmission elements and/or holders 6. In particular, one or more transmission elements of the other exemplary embodiments can be provided, in particular one or more rotation elements 40*a*, 40*b* and/or threaded rods 60 and/or pressure rods 52 per one holder pair 6. The embodiments of FIGS. 1 to 8 can also have one or more actuators 62 for converting and/or transforming a pulse into a movement of one or more transmission elements and/or holders.

Furthermore, two or more adjacent and substantially identically aligned holder pairs 6 can be displaceable and/or adjustable via one or more transmission elements of the same transmission strand 50, as shown for example in FIG. 4. As a result, a reduced number of transmission elements can be provided for adjusting a plurality of holder pairs 6, so that lower component costs and reduced complexity of the packaging bag receiving apparatus 1 are achieved.

REFERENCE NUMERAL LIST

1 packaging bag receiving apparatus
2 packaging bag
4 packing material
6 holder pair
8 holder
10 holder element
12 distance adjusting device
14 rail
16 cable pull
18 return spring
20 packaging machine
22 feed device
24 forming or folding device
26 connecting device
28 separating device
32 rotary machine
34 pocket forming device
36 introduction device
38 closing device
40*a* first rotation element

40*b* second rotation element
42 motion transmitter
44 pin
46 groove
50 transmission strand
50 transmission element
52 push rod
54 spindle nut or movement nut
56 gear
58 rack
60 threaded rod
62 actuator
64 shaft
A distance

The invention claimed is:

1. A packaging bag receiving device for a packaging machine for receiving a plurality of packaging bags, comprising: a plurality of holder pairs for holding a respective packaging bag, wherein each holder pair comprises a first holder and a second holder arranged at a predetermined distance to the first holder, and wherein at least the first holder of a holder pair is displaceable with respect to the second holder of the holder pair; and a distance adjusting device for substantially simultaneously adjusting distances between the holders of each holder pair by displacing at least the first holder relative to the second holder of each holder pair;

wherein the distance adjusting device comprises:

a plurality of transmission strands comprising one or more transmission elements, each transmission strand from the plurality of transmission strands being configured to respectively adjust a distance between the holders of one holder pair from the plurality of holder pairs; and wherein each transmission strand comprises an actuator.

2. The packaging bag receiving device according to claim 1, wherein the distance adjusting device is adapted to respectively displace the first holders and the second holders of all holder pairs substantially simultaneously and substantially uniformly.

3. The packaging bag receiving device according to claim 1, wherein the distance adjusting device is configured to respectively displace the first holders and the second holders of all holder pairs simultaneously and oppositely directed to one another.

4. The packaging bag receiving device according to claim 1, wherein the distance adjusting device is configured to adjust the distance (A) between the first holders and the second holders according to a width of a packaging bag to be held.

5. The packaging bag receiving device according to claim 1, wherein the holder pairs are arranged corresponding to the edges of a polygon, wherein at least two holder pairs are arranged on the same edge of the polygon.

6. The packaging bag receiving device according to claim 5, wherein the distance setting device is designed to adjust the distances of holder pairs arranged at different edges of the polygon simultaneously, identically, or correspondingly.

7. The packaging bag receiving device according to claim 1, wherein the packaging bag receiving device comprises 5, 6, 7, 8, 10, 12, 14, 16, 20, 24, 30, 32, 40, or 50 holder pairs.

8. The packaging bag receiving device according to claim 1, wherein each holder has two holder elements, wherein at least one holder element is displaceable with respect to the other holder element, and wherein each holder pair is configured to hold a respective packaging bag by engaging the holder elements of the holders with at least a part of a packaging bag.

9. The packaging bag receiving device according to claim 1, wherein the packaging bag receiving device is rotatably mounted and configured to displace or transport held packaging bags, along a circular path curve.

10. The packaging bag receiving device according to claim 1, wherein the packaging bag receiving device is configured to displace or transport at least one packaging bag held by a selected holder pair to a pocket forming device; and wherein the distance adjusting device is configured to temporarily displace at least one holder of the selected holder pair for temporarily reducing the set distance (A) of the holders of the selected holder pair, such that the packaging bag forms a pocket.

11. The packaging bag receiving device according to claim 1, wherein the distance adjusting device comprises:

at least one transmission strand comprising one or more transmission elements, wherein the at least one transmission strand is configured to receive an impulse from a movement transmitter and to respectively transfer it to at least one holder of the holder pairs.

12. The packaging bag receiving device according to claim 11, wherein the transmission strand comprises:

a first rotation element which is coupled to the movement transmitter such that a displacement of at least one part of the movement transmitter causes a displacement of the first rotation element; and wherein the displacement of the first rotation element causes a displacement of the respective first holder of the holder pairs.

13. The packaging bag receiving device according to claim 12, wherein the transmission strand further comprises:

a second rotation element which is coupled to the movement transmitter, such that a displacement of at least one part of the movement transmitter causes a displacement of the second rotation member in substantially opposite direction to the first rotation member; and wherein the displacement of the second rotation element causes a displacement of the respective second holder of the holder pairs, in an opposite direction to the respective first holder.

14. The packaging bag receiving device according to claim 11, wherein each transmission strand comprises at least one of:

a cable pull;
a push rod;
a threaded rod;
a spindle nut;
a gear;
a rack;
an actuator; or
a shaft.

15. The packaging bag receiving device according to claim 14, wherein each transmission strand from a plurality of transmission strands is configured to set a distance between the holders of each holder pair from the plurality of holder pairs, by simultaneously and uniformly or correspondingly displacing the at least one holder of the plurality of holder pairs.

16. A packaging bag receiving device according to claim 1, further comprising:

a movement transmitter for generating an impulse.

17. A packaging machine for at least one of producing, filling, or closing one or more packaging bags comprising a packaging bag receiving device for receiving a plurality of packaging bags, the packaging bag receiving device comprising:

a plurality of holder pairs for holding a respective packaging bag, wherein each holder pair comprises a first holder and a second holder arranged at a predetermined distance to the first holder, and wherein at least the first holder of a holder pair is displaceable with respect to the second holder of the holder pair; and a distance adjusting device for simultaneously adjusting distances between the holders of each holder pair by displacing at least the first holder relative to the second holder of each holder pair;

wherein the distance adjusting device comprises:

a plurality of transmission strands comprising one or more transmission elements, each transmission strand from the plurality of transmission strands being configured to respectively adjust a distance between the holders of one holder pair from the plurality of holder pairs; and wherein each transmission strand comprises an actuator.

18. A method for simultaneously adjusting a predetermined distance (A) of a respective first holder and a second holder of a plurality of holder pairs of a packaging bag receiving device for receiving one or more packaging bags, wherein the method comprises:

displacing at least one holder of the plurality of holder pairs by using a distance adjusting device, wherein the distance adjusting device comprises:

a plurality of transmission strands comprising one or more transmission elements, each transmission strand from the plurality of transmission strands being configured to respectively adjust a distance between the holders of one holder pair from the plurality of holder pairs; and wherein each transmission strand comprises an actuator;

bringing at least one holder pair into engagement with a packaging bag; and displacing, in particular rotating, the packaging bag receiving device for displacing or transporting the at least one held packaging bag, along at least a part of a substantially circular path curve, wherein the plurality of holder pairs are arranged corresponding to different edges of a polygon.

19. The method of claim 18, further comprising:

displacing a first holder of a selected holder pair with respect to a second holder of the holder pair by the distance adjusting device for forming a pocket with the packaging bag during holding of a packaging bag.

* * * * *